US007775393B1

(12) United States Patent
Feldman et al.

(10) Patent No.: US 7,775,393 B1
(45) Date of Patent: Aug. 17, 2010

(54) COMBINATION CLOSURE-CUP ASSEMBLY

(76) Inventors: Vladimir Feldman, 2611 E. 13th St., Brooklyn, NY (US) 11209; Eduard Iskov, 2611 E. 13th St., Brooklyn, NY (US) 11209

( * ) Notice: Subject to any disclaimer, the term of this patent is extended or adjusted under 35 U.S.C. 154(b) by 641 days.

(21) Appl. No.: 11/801,224

(22) Filed: May 9, 2007

(51) Int. Cl.
*A47G 19/22* (2006.01)
*B65D 53/00* (2006.01)
*B65D 51/00* (2006.01)
*B65D 83/00* (2006.01)

(52) U.S. Cl. ..... 220/709; 220/304; 215/229; 215/388

(58) Field of Classification Search ..... 220/709, 220/710, 707, 705, 203.19, 202; 215/388, 215/11.6, 229, 45, 44, 43, 341, DIG. 7, 316, 215/200; 206/547, 541; D7/300.2; 222/153.01, 222/532, 531, 522; 277/354
See application file for complete search history.

(56) References Cited

U.S. PATENT DOCUMENTS

| | | | | | |
|---|---|---|---|---|---|
| 1,370,665 | A | * | 3/1921 | Moore | 222/92 |
| 1,441,793 | A | | 1/1923 | Gay | |
| 2,582,934 | A | | 1/1952 | Parsons | 215/100 |
| 2,748,968 | A | * | 6/1956 | Attler | 215/324 |
| 2,989,203 | A | | 6/1961 | Bramming | 215/13 |
| 3,021,977 | A | * | 2/1962 | Hester | 220/718 |
| 3,191,645 | A | | 6/1965 | Dailey | 141/381 |
| 3,227,301 | A | | 1/1966 | Cornelius | 215/13 |
| 3,373,864 | A | * | 3/1968 | Neely et al. | 206/471 |
| 3,618,807 | A | * | 11/1971 | Rownd | 220/592.17 |
| 3,684,120 | A | | 8/1972 | Beeman | 215/100 R |
| 3,823,841 | A | | 7/1974 | Lovejoy | 215/39 |
| 3,826,397 | A | | 7/1974 | Atkins | 215/41 |
| 3,828,962 | A | | 8/1974 | Atkins | 215/321 |
| 4,106,673 | A | * | 8/1978 | Donoghue | 222/207 |
| 4,150,761 | A | | 4/1979 | Collins | 215/228 |
| D251,950 | S | | 5/1979 | McGowen | D9/10 |
| 4,170,316 | A | | 10/1979 | LaBarbera | 220/306 |
| D255,648 | S | | 7/1980 | Bolter | D9/10 |
| 4,230,230 | A | | 10/1980 | Mumford | 215/321 |
| D258,045 | S | | 1/1981 | Collins | D9/337 |
| 4,273,247 | A | | 6/1981 | Earls | 215/228 |
| D260,078 | S | | 8/1981 | Casoni | D9/337 |
| 4,326,638 | A | | 4/1982 | Nickel | 215/12 R |
| 4,349,056 | A | | 9/1982 | Heino | 141/381 |
| 4,416,381 | A | | 11/1983 | Swartwout | 215/228 |
| 4,438,856 | A | | 3/1984 | Chang | 215/12 R |
| D274,981 | S | | 8/1984 | Hoyt | D9/337 |
| 4,474,312 | A | * | 10/1984 | Donoghue | 222/205 |
| 4,489,840 | A | | 12/1984 | Freitas | 215/13 R |
| D277,821 | S | | 3/1985 | Nestrock | D7/77 |
| 4,530,439 | A | | 7/1985 | Finnell | 220/90.4 |
| 4,544,073 | A | | 10/1985 | Willis | 215/246 |

(Continued)

*Primary Examiner*—Anthony Stashick
*Assistant Examiner*—Robert J Hicks
(74) *Attorney, Agent, or Firm*—Law Offices of J.D. Geraigery; Janine D. Geraigery

(57) ABSTRACT

A combination closure-cup assembly including a rotatably removable cup for securing to a bottle. The bottle having an inner cavity, frusto-conical neck and spout including external threading, and an annual peripheral flange extending outwardly from the frusto-conical neck below the external threading. The cup has a first end having a circular flat bottom including a scalloped rim, a second end, and a frusto-conical neck portion connecting the first and second end. The cup includes an outer surface, an internal cavity having threading, an inwardly recessed straw aperture, and a leak proof seal. The outer surface has a plurality of axial ribs.

7 Claims, 2 Drawing Sheets

U.S. PATENT DOCUMENTS 4,550,862 A 11/1985 Barker ..... 222/109
4,566,509 A 1/1986 Szajna ..... 141/381
4,632,273 A 12/1986 Rhine ..... 220/411
4,717,037 A 1/1988 van der Meulen ..... 220/90.6
4,727,985 A 3/1988 McNeirney ..... 206/221
4,834,251 A 5/1989 Yu ..... 215/222
4,858,777 A 8/1989 Morel ..... 215/295
4,883,203 A 11/1989 Kittscher ..... 222/143
4,940,138 A 7/1990 Hornstein ..... 206/218
4,944,704 A * 7/1990 Grace ..... 446/74
D309,712 S 8/1990 Bezek ..... D9/337
D310,028 S 8/1990 Brandt ..... D9/434
4,984,723 A 1/1991 Hsu ..... 224/148
D316,369 S 4/1991 Thompson ..... D9/337
D316,815 S * 5/1991 Kalin et al. ..... D9/542
D321,317 S 11/1991 Sherman ..... D9/337
5,078,289 A 1/1992 Bolton ..... 215/228
D325,697 S 4/1992 Parr ..... D9/352
5,114,374 A * 5/1992 Estiva ..... 446/77
5,127,553 A * 7/1992 Weinstein ..... 222/158
5,330,081 A * 7/1994 Davenport ..... 222/207
5,518,143 A * 5/1996 Iodice ..... 220/708
5,544,769 A 8/1996 Dowler ..... 215/227
5,632,407 A 5/1997 Christensen ..... 220/717
5,762,120 A 6/1998 Smith ..... 141/340
5,794,803 A 8/1998 Sprick ..... 215/217
D398,236 S 9/1998 Huang ..... D9/502
5,799,811 A 9/1998 Bruckner ..... 215/386
5,881,894 A * 3/1999 Gargano ..... 215/228
D410,364 S 6/1999 Ramirez ..... D7/507
D419,868 S 2/2000 DeVore ..... D9/337
6,126,024 A 10/2000 Ramirez ..... 215/12.1
6,164,473 A 12/2000 Waldrip ..... 215/378
6,209,737 B1 4/2001 Bliss ..... 215/228
6,330,960 B1 * 12/2001 Faughey et al. ..... 222/205
6,405,675 B1 6/2002 Mills ..... 119/74
D464,139 S 10/2002 Iodice ..... D24/197
D471,460 S 3/2003 Paul ..... D9/516
D471,819 S 3/2003 Paul ..... D9/524
D473,460 S 4/2003 Whitworth ..... D9/337
D479,995 S 9/2003 Duceppe ..... D9/444
6,662,959 B1 12/2003 Westerhold ..... 215/378
6,705,491 B1 3/2004 Lizerbram ..... 222/145.1
6,848,484 B1 2/2005 Darr ..... 141/381
D503,589 S 4/2005 Schuler ..... D7/608
6,904,867 B2 6/2005 Zamjahn ..... 116/308
6,905,038 B2 6/2005 Lopez ..... 215/228
6,923,344 B1 * 8/2005 Chien ..... 222/158
2001/0035417 A1 11/2001 Kantor
2004/0140315 A1 7/2004 Reinoso
2004/0159625 A1 8/2004 Kwon
2005/0115978 A1 6/2005 de la Guardia
2005/0155974 A1 7/2005 Amron
2007/0114202 A1 * 5/2007 Lee ..... 215/311
2007/0125744 A1 * 6/2007 Samman ..... 215/388
2008/0302754 A1 * 12/2008 Lewin ..... 215/229

* cited by examiner

COMBINATION CLOSURE-CUP ASSEMBLY

BACKGROUND OF THE INVENTION

1. Field of the Invention

The invention relates to beverage bottles, and more particularly, to a combination closure-cup assembly for securing to a bottle and allowing users to receive drinks at a greatly enhanced convenience when traveling or engaging in sports activities.

2. Description of the Related Art

Hundreds of thousands of people carry around bottles of liquid beverages with them each day. It is a big imposition and inconvenience to carry around a cup as well especially to sport events, activities, driving, tours or travels. The present invention seeks to eliminate this disadvantage by combining a bottle closure with a cup. The invention thereby allows consumers to close a standard bottle with this unique device which can then be used as a cup. In addition, the present invention is capable of being used with a straw, and has a means in place to transporting the straw therein. Therefore, the present invention is advantageous over the prior art.

U.S. Pat. No. 4,273,247 to Ears discloses a bottle closure-cup assembly for use with a bottle having a rotatably removeable cap.

U.S. Pat. Application No. 2004/0159625 to Kwon discloses a dual chambered beverage bottle made of synthetic resin.

While these units may be suitable for the particular purpose employed, or for general use, they would not be as suitable for the purposes of the present invention as disclosed hereafter.

SUMMARY OF THE INVENTION

It is an object of the invention to produce a means for conveniently sealing and closing a bottle, while easily drinking from the same apparatus.

It is another object of the invention to provide a means for eliminating the inconvenience of carrying a cup along with a bottle for a drinking beverage to sport events, activities, driving, tours or travels.

It is an object of the invention to provide a rotatably, removable and reusable beverage cup.

It is another object of the invention to provide a closure-cup assembly including a cup that is adapted to be used as an easy to grip and open handle by users.

It is another object of the invention to provide a means for including a straw within the closure cup assembly.

It is yet another object of the invention to provide an annual peripheral flange for stopping excessive rotation of the cup when it seals the bottle.

This invention is a combination closure-cup assembly including a rotatably removable cup for securing to a bottle. The bottle having an inner cavity, frusto-conical neck and spout including external threading, and an annual peripheral flange extending outwardly from the frusto-conical neck below the external threading. The cup has a first end having a circular flat bottom including a scalloped rim, a second end, and a frusto-conical neck portion connecting the first and second end. The cup includes an outer surface, an internal cavity having threading, an inwardly recessed straw aperture, and a leak proof seal. The outer surface has a plurality of axial ribs.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
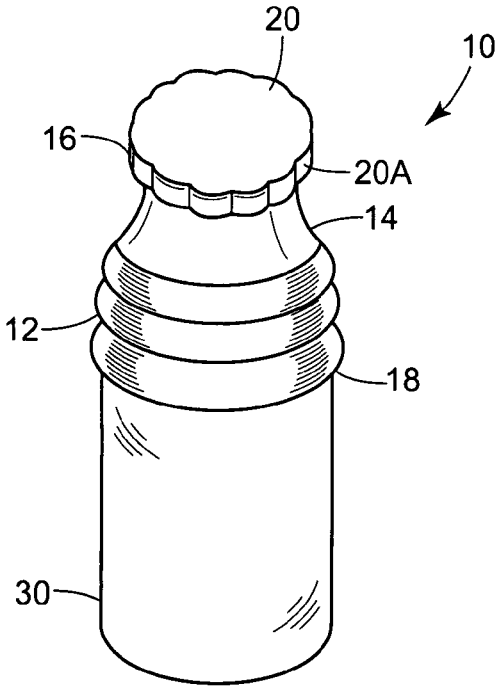
FIG. 1 is a diagrammatic perspective view of a combination bottle and closure-cup assembly of the present invention.

FIG. 1 illustrates a closure-cup assembly 10 constructed and arranged in accordance with the present invention. The closure-cup assembly 10 is used in conjunction with a bottle 30, and is capable of closing and sealing the bottle. Preferably, the closure-cup assembly 10 is made out of plastic or aluminum, and can be used with small and wide neck bottles, as well as, plastic, glass and/or aluminum bottles.

The closure-cup assembly 10 includes a rotatably removable cup 12 having a frusto-conical neck portion 14 connecting a first end 16 and second end 18. The cup includes an outer surface 12A. The first end 16 includes a circular flat bottom 20 which includes a scalloped rim 20A ideal for easy griping. The outer surface 12A of the second end 18 of the cup 12 is formed with a plurality of axial ribs 22 for assisting in engaging with a bottle, holding during drinking and being used as a lip while drinking from the cup 12. The scalloped rim 20A is adapted to be used as an easy to grip handle by users.

Figure 2:
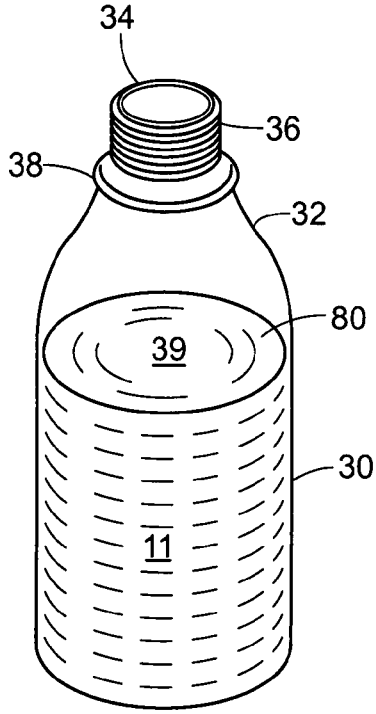
FIG. 2 is a diagrammatic perspective view of a bottle for use with the present invention having a liquid filled inner cavity a spout having external threads.

FIG. 2 illustrated the bottle 30, which is substantially cylindrical in shape and includes a frusto-conical neck 32 and spout 34. The spout 34 includes external threading 36. An annual peripheral flange 38 extends outwardly from the frusto-conical neck 32 just below the external threading 36. The bottle 30 includes an inner cavity 39.

Figure 3:
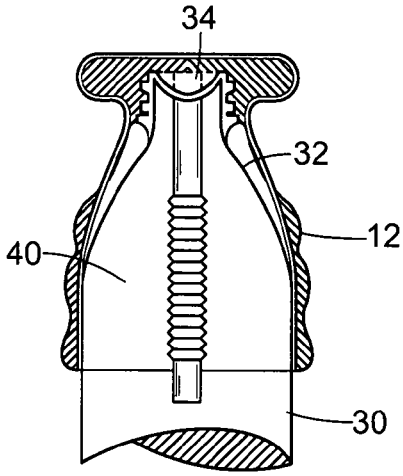
FIG. 3 is a partial cross-sectional view of the combination closure-cup assembly of the present invention, wherein the closure-cap assembly is in use receiving a bottle and straw.

FIG. 3 illustrates a partial view of the cup 12 after receiving the bottle 30. The cup 12 has an internal cavity 40 for receiving the spout 34 and frusto-conical neck 32 of bottle 30. The cup 12 is available in different embodiments and shapes in order to receive different bottles having differing neck widths.

Figure 4:
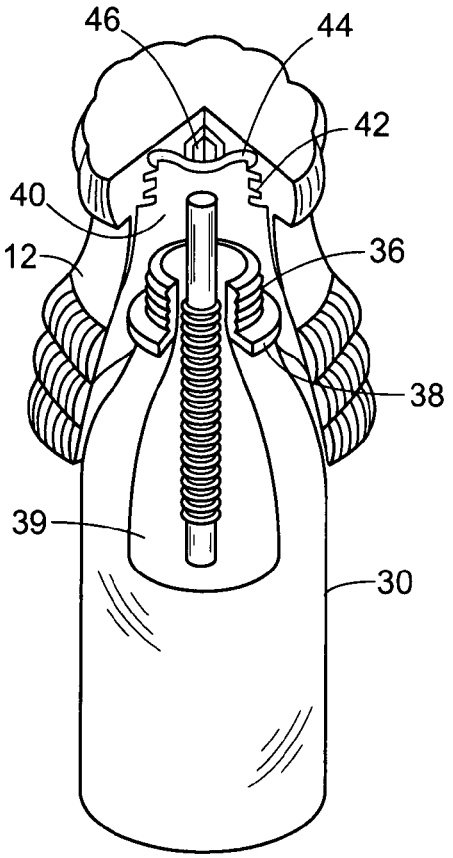
FIG. 4 is an exploded sectional view of the combination closure-cup assembly of the present invention.

FIG. 4 illustrates the cup 12 just prior to receiving the bottle 30. The internal cavity 40 of the cup 12 includes threading 42 for receiving and interlocking with the external threading 36 of the bottle 30 such that the cup 12 securely closes the bottle 30 and holds liquid therein. The threading 42 of the cup 12 is covered with a leak proof seal 44, which covers over an inwardly recessed straw aperture 46. The annual peripheral flange 38 of the bottle 30 is used for stopping excessive rotation of the cup 12 when closing the bottle 30 therewith.

Figure 5:
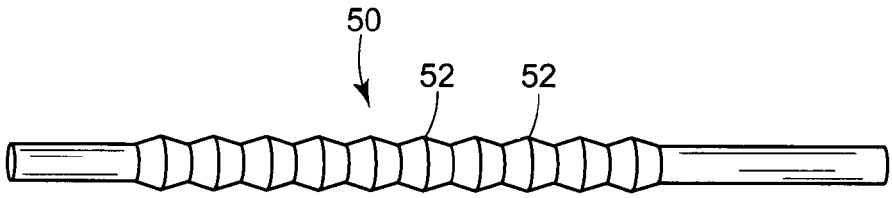
FIG. 5 is a diagrammatic perspective view of a straw for use with the combination closure-cup assembly of the present invention.

FIG. 5 illustrates a standard flexible straw 50, having accordion ridges 52 for selectively lengthening and shortening. The straw in FIG. 5 is shown extending outwardly from the inner cavity 39 of the bottle 30 upwardly through the spout 34. The straw 50 extends upwardly through the leak proof seal 44 and into the inwardly recessed straw aperture 46. Preferably, the straw 50 is shortened and inserted into the inwardly recessed straw aperture 46 and closed within the inner cavity 39 of the bottle 30 during manufacturing. After cup 12 is removed from the spout 34 of the bottle 30 the straw 50 is separated and pulled out from the inwardly recessed straw aperture 46 and lengthened for regular use as the straw 50. The closure-cup assembly 10 can be used with or without the straw 50.

Figure 6:
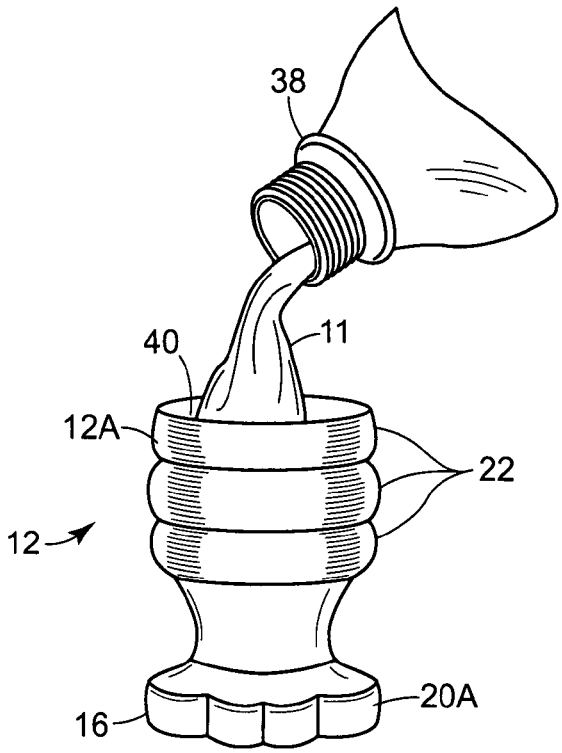
FIG. 6 is a diagrammatic perspective view of the closure-cup of the combination closure cup assembly being filled with a liquid beverage.

FIG. 6 illustrates the cup 12 in use as a standard drinking cup being filled with liquid beverage 11 from the inner cavity 39 of the bottle 30. In use, a user twists off the cup 12 from the bottle 30 by gripping the scalloped rim 20A of the cup and allowing the external threads 36 of the bottle to unlock from the threading 42 of the cup 12. Then, the cup 12 is turned upside down such that the circular flat bottom 20 of the first end 16 is against a table or flat surface. Next, the user pours the liquid beverage 11 from the bottle 30 into the internal cavity 40 of the cup 12. Then, the user can drink the liquid beverage 11 directly from the cup 12 using the axially ribs 22 as a lip, or alternatively, drinking from the straw 50 as it extends upwardly through the inwardly recessed straw aperture 46 and leak proof seal 44. Once the user's thirst is exhausted, the user simple replaces the cup 12 onto the bottle and selectively closes the bottle 12 by twisting the scalloped rim 20A causing the threading 42 of the cup 12 to interlock with the external threads 36 of the bottle 30. The annual peripheral flange 38 prohibits excessive rotation of the cup 12.

In conclusion, herein is presented combination closure-cap assembly 10. The invention is illustrated by example in the drawing figures, and throughout the written description. It should be understood that numerous variations are possible, while adhering to the inventive concept. Such variations are contemplated as being a part of the present invention.

What is claimed is:

1. A combination closure-cup assembly, comprising:

a substantially cylindrical bottle having a frusto-conical neck and spout, said spout including external threading, and an annual peripheral flange extending outwardly from the frusto-conical neck below the external threading, said bottle including an inner cavity; and a rotatably removable cup having an outer surface, a first end, and a second end, having a frusto-conical neck portion connecting the first and second end, said first end including a circular flat bottom including a scalloped rim, said outer surface of the second end having a plurality of axial ribs, having an internal cavity having threading, an inwardly recessed straw aperture, a leak proof seal covering over said aperture and threading, said internal cavity for receiving the spout and frusto-conical neck of said bottle and interlocking with the external threading of the bottle.

2. The combination closure-cup assembly of claim 1, further comprising a flexible straw having accordion ridges for lengthening and shortening, said straw extends outwardly from the inner cavity of the bottle upwardly through the spout and extends upwardly through the leak proof seal and into the inwardly recessed straw aperture.

3. A closure-cup assembly, for use with a cylindrical bottle having an inner cavity and a spout including external threading, comprising:

a rotatably removable cup having an outer surface, a first end, and a second end, having a frusto-conical neck portion connecting the first and second end, said first end including a circular flat bottom including a scalloped rim, said outer surface having a plurality of axial ribs, having an internal cavity having threading, an inwardly recessed straw aperture, a leak proof seal covering over said aperture and threading, said internal cavity for receiving the spout and frusto-conical neck of said bottle and interlocking with the external threading of said bottle.

4. The closure-cup assembly, of claim 3, further comprising a flexible straw having accordion ridges for lengthening and shortening, said straw extends outwardly from the inner cavity of the bottle upwardly through the spout and extends upwardly through the leak proof seal and into the inwardly recessed straw aperture.

5. A method of conveniently sealing a bottle and drinking from a cup utilizing the closure-cup assembly of claim 1, the steps comprising:

twisting off the cup from the bottle by gripping the scalloped rim of the cup and allowing the external threads of the bottle to unlock from the threading of the cup;

turning the cup upside down and laying down the circular flat bottom of the first end downward;

pouring a liquid beverage from the bottle into the internal cavity of the cup; and drinking the liquid beverage directly from the cup.

6. The method of conveniently sealing a bottle and drinking from a cup of claim 5, further comprising the step of drinking from the straw as it extends upwardly through the inwardly recessed straw aperture and leak proof seal.

7. The method of claim conveniently sealing a bottle and drinking from a cup of claim 5, further comprising the step of replacing the cup onto the bottle and closing the bottle by twisting the scalloped rim and causing the threading of the cup to interlock with the external threads of the bottle.

* * * * *